US008485750B2

(12) United States Patent
Baker et al.

(10) Patent No.: US 8,485,750 B2
(45) Date of Patent: Jul. 16, 2013

(54) FILE BINDER AND DOCUMENT ORGANIZER

(75) Inventors: Jeff Baker, Orlando, FL (US); Mark Bunker, Orlando, FL (US); Seth Freytag, Orlando, FL (US); Kelly Harden, Orlando, FL (US); Paul van der Pol, Winter Garden, FL (US)

(73) Assignee: Promising Ground, LLC, Orlando, FL (US)

( * ) Notice: Subject to any disclaimer, the term of this patent is extended or adjusted under 35 U.S.C. 154(b) by 345 days.

(21) Appl. No.: 12/877,966

(22) Filed: Sep. 8, 2010

(65) Prior Publication Data

US 2012/0057925 A1 Mar. 8, 2012

(51) Int. Cl.
*B42F 3/00* (2006.01)
*B42F 13/40* (2006.01)

(52) U.S. Cl.
USPC ..... 402/4; 402/73; 402/502; D19/27

(58) Field of Classification Search
USPC ..... 402/70, 73, 4, 502; D19/27
See application file for complete search history.

(56) References Cited

U.S. PATENT DOCUMENTS

| | | | | | |
|---|---|---|---|---|---|
| 5,993,099 | A | * | 11/1999 | Greenberg et al. | 402/4 |
| 6,017,062 | A | * | 1/2000 | White | 402/73 |
| 6,161,979 | A | * | 12/2000 | Yamamoto et al. | 402/73 |
| 6,558,062 | B1 | * | 5/2003 | Wyant et al. | 402/73 |
| D518,105 | S | * | 3/2006 | Hough et al. | D19/27 |
| 7,055,564 | B2 | * | 6/2006 | Carey et al. | 402/73 |
| 7,704,006 | B2 | | 4/2010 | Merzon | |
| 2005/0207827 | A1 | * | 9/2005 | Busam et al. | 402/73 |
| 2007/0297849 | A1 | * | 12/2007 | Merzon | 402/73 |
| 2008/0304901 | A1 | * | 12/2008 | Seman | 402/70 |

* cited by examiner

*Primary Examiner* — Dana Ross
*Assistant Examiner* — Kyle Grabowski
(74) *Attorney, Agent, or Firm* — Timothy H. Van Dyke; Beusse, Wolter, Sanks, Mora & Maire, P.A.

(57) ABSTRACT

Disclosed herein is an organizer comprising a unique structural configuration to house and store both non-perforated documents and perforated documents. The organizer comprises a ring binder that is associated with an expandable compartment that is arranged peripheral to the ring binder.

18 Claims, 6 Drawing Sheets

FILE BINDER AND DOCUMENT ORGANIZER

BACKGROUND

People are required to manage many pieces of information in the course of a typical day, relating to appointments, errands, projects and responsibilities. In addition, a person has goals and other personal matters which need to be incorporated into the planning of one's day in order for them to be realized. Besides the recurring and/or ordinary pieces of information an individual must track and record (which can clutter a person's mind or workplace), it is necessary to make note of new and important ideas lest they be forgotten. In general, having to remember a great many pieces of information tends to make a person feel overwhelmed and therefore, less productive and creative.

Wire bound or spiral bound notebooks have been on the market for many years. Conventionally, the wire bound notebook includes a pair of separate cover members which include wire receiving hole's or perforations along their inner edges and along the inner edges of loose leaf sheets bound into the notebook. The wire is wound helically through the registered perforations of the discrete cover members and those of the pad of paper. Similarly, three-ring binders have been available for years that have a number of binding jaws that open and close to secure loose leaf paper. Both styles of binders require that the document being held must be perforated in order to have the wire or binding jaws engage the document.

U.S. Pat. No. 7,704,006 teaches a ring binder that contains an expandable pocket. Documents may be held in the slits provided in the expandable pocket. The expandable pocket is held in place and restrained by the binder covers and the zip able skirt.

The inventors have realized a number of new binder configurations that substantially increase storage of documents that must not be perforated and which allow increased efficiency in organizing all types of documents and related samples.

DETAILED DESCRIPTION

Figure 2:
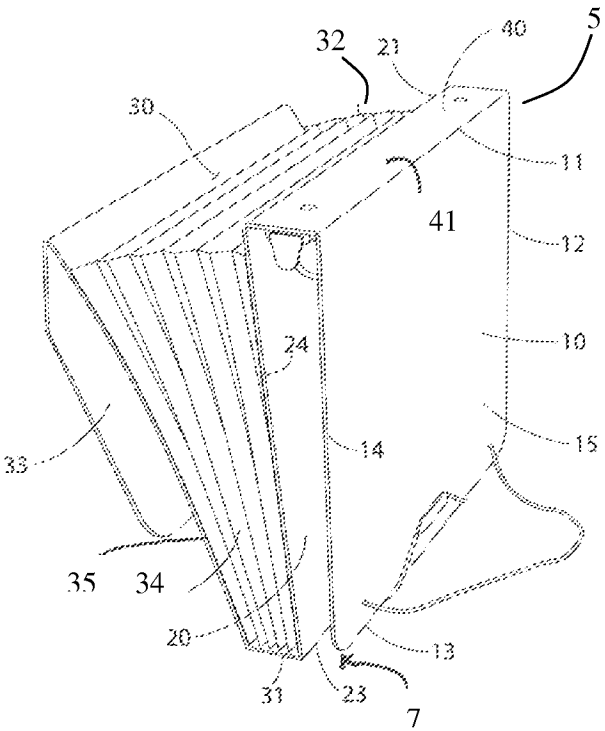
FIG. 2 shows a side perspective view of the embodiment shown in FIG. 1 with the expandable compartment in an opened position.

The inventors have realized that many business and scholastic activities require the organization of both structural information, which has a fixed sequence and a unstructured information which does not have a fixed sequence. A binder is a good tool to keep structured information while a file folder is a good tool to keep unstructured information. According to certain aspects of the present invention, the invention enables the storage and organization of structured and unstructured information securely together in one place.

According to a first embodiment, the invention pertains to an organizing binder that includes a first planar cover member and a second planar cover member. The first and second planar cover members each include an outer surface, an inner surface, a proximal edge, a distal edge, a top edge and a bottom edge. The embodiment also includes a bridge member that has a planar bridge body portion. The body portion includes a bridge inner surface, a bridge outer surface, a first bridge outer edge and a second bridge outer edge. The first bridge outer edge associates with the first planar cover member proximal edge and the second bridge outer edge associates with the second planar member proximal edge. The term "associate(s)", or forms thereof, with respect to different elements of an inventive embodiment includes a direct or indirect engagement or integration amongst the elements. The embodiment also includes a binding mechanism associated with the bridge inner surface. The binding mechanism includes a plurality of binding members that move from a released state to binding state. The embodiment also includes an outwardly expanding compartment associated with the first planar cover member outer surface. The expandable compartment includes a first wall portion, a second wall portion, and an optional third wall portion spanning between an compartment outer cover and the first planar cover member outer surface. The first, second, or third wall portions, or a combination thereof, have excess material that enables expansion of the compartment outer cover away from the first planar cover member outer surface.

In a more specific embodiment, the aforementioned first, second or third wall portions, or combination thereof include a series of folds. In an even more specific embodiment, the expandable compartment includes two or more separate slits into which material may be separately stored.

With reference to other specific embodiments that have an expandable compartment, the binder further includes a compartment flap that moves from an open position, where material in the expandable compartment may be accessed, to a closed position, where material in said expandable compartment is inaccessible. According to one example, the compartment flap includes a compartment flap first end that is associated with the bridge member and a compartment flap second end that is secured to the compartment outer cover. According to another example, the compartment flap includes a compartment flap first end that is associated with the compartment outer cover and a compartment flap second end that is secured to the second planar member outer surface. In yet another example, the compartment flap includes a compartment flap first end that is associated with the first planar outer surface and a compartment flap second end that is secured to the compartment outer cover.

According to another embodiment, the binder includes a latching means for securing a compartment flap. The latching means may take several forms and configurations, that will be apparent to those skilled in the art equipped with the teachings herein. In no way intended to be limiting, examples of latching means, include but art not limited to, hook and loop fabric adhered to the compartment flap, a catching member that grabs a stretchable cord, a snap, a button/slit configuration, a clip, a zipper, or a magnet. Depending on the version or example of the inventive binder embodiment, a portion of the latching means will typically be associated with the compartment flap that interacts with another portion of the latching mechanism that is associated with the binder at a separate location.

According to another embodiment, the invention pertains to a binder that includes an outwardly expanding compartment along with retractable hanging members. The retractable hanging members will support and carry the binder on a support frame, such as those typically found in filing cabinets. The retractable hanging members may include a first set of hanging members that are configured to extend in a first end direction and a second set of hanging members that extend in a second end direction. When the retractable hanging members are in a closed state, they are generally unexposed from the binder and when in an open state, they are exposed and ready for supporting the binder.

The hanging members can be placed at different selected locations of the binder. For example, one hanging member may be placed on the first planar cover member and another hanging member placed on the second planar cover member, or compartment outer cover. Typically, a set of two or more hanging members are arranged at a first end of the binder and a set of two or more hanging members are arranged at a second end of the binder. In a specific embodiment, the set of hanging members extend out the end of the binder in a parallel fashion. In a specific embodiment, the hanging member includes an elongated body portion, a distal end, a tab at the distal end, and an indention defined at the distal end. The indentation and the tab assist in retaining the binder on a support device.

Figure 1:
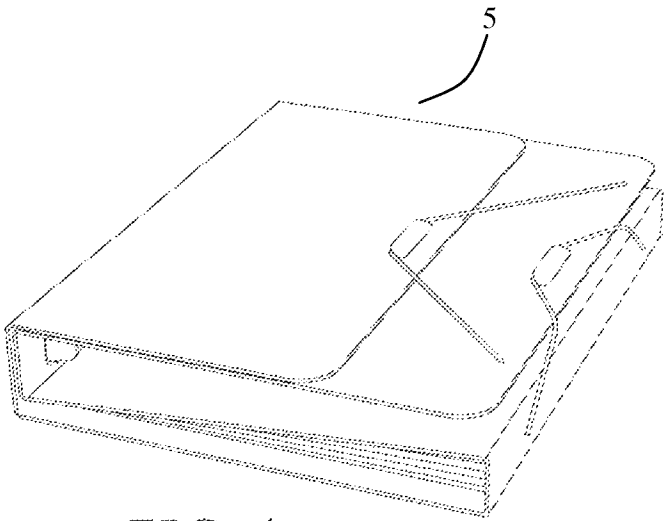
FIG. 1 shows a side perspective view of an embodiment of the invention.

Turning now to the drawings, FIGS. 1 and 2 show a side perspective view of an organizing binder embodiment 5. FIG. 2 shows the embodiment 5 with an expandable compartment 30 in an opened position. The organizer 5 includes a ring binder 7 that comprises a first planar cover member 10 with a proximal edge 11, a first end edge 12, a distal edge 13, a second end edge 14, and a top surface 15. Associated with the proximal edge 11 of the first planar cover member 10 is a bridge member 40. The bridge member has an outer surface 41. The ring binder 7 also includes a second planar cover member 20 having a proximal edge 21. The second planar cover member 20 is associated with the bridge member 40 at proximal edge 21. The second planar cover member 20 has a second end edge 24.

Figure 4:
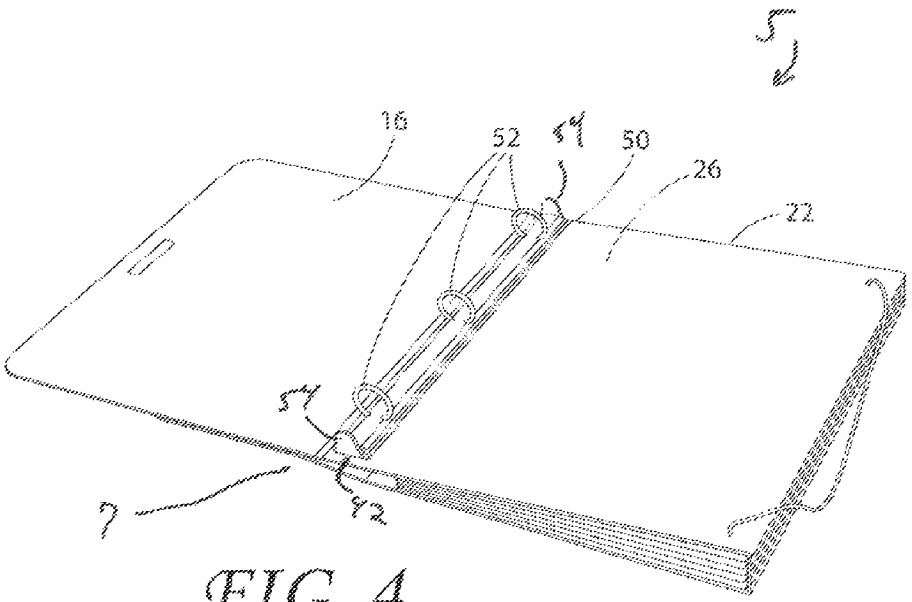
FIG. 4 shows a bottom perspective view of the embodiment shown in FIGS. 1-3 with a binder in an opened position.
Figure 3:
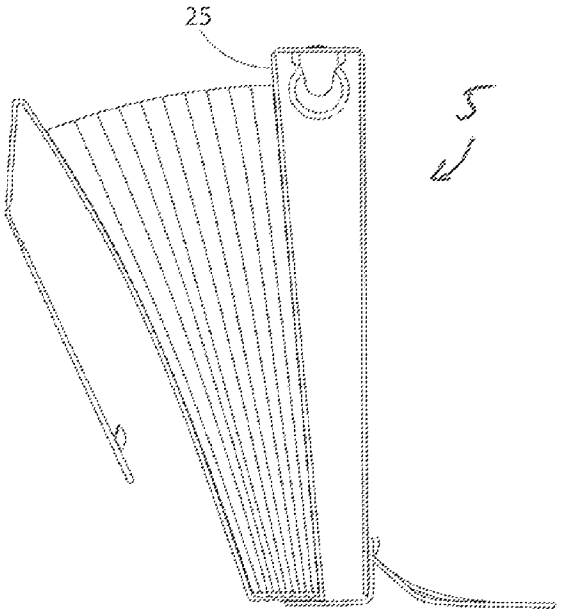
FIG. 3 shows a side view of the embodiment shown in FIGS. 1 and 2.

FIG. 3 shows an end view of the embodiment 5 that reveals second planar cover member outer surface 25. FIG. 4 shows an end perspective view of the embodiment 5 with the binder 7 in an opened position to reveal a first planar cover member inner surface 16, a second planar cover member inner surface 26 and a first end edge 22 of the second planar cover member 20. The bridge member inner surface 42 is revealed in FIG. 4 as well. Associated on the inner surface 42 of the bridge member 41 is a binder mechanism 50 having a plurality of binding members 52. The binder members 52 are opened and closed by manipulating actuators 54.

Returning to FIG. 2, the embodiment 5 also includes an expandable compartment 30 that has a first wall portion 32 and a second wall portion 34. Associated with the first and second wall portions is a compartment outer cover 35. As shown, the first and second wall portions 32, 34 fold in an accordion-like fashion. Those skilled in the art will appreciate that the walls 32, 34 may take numerous different configurations and/or made of different materials. For most typical embodiments, it is important for the functionality of the walls that there be a supernumerary amount of material so as to enable expansion of the walls 32, 34 that in turn separates at least part of the compartment outer cover 35 away from the second planar cover member outer surface 25. Associated with the compartment outer cover 35 is a compartment flap 33. The compartment flap 33 is shown in an open position. As will be discussed in further detail below, the organizer binder 5 may be stored in a file cabinet or similar storage device. Depending on the desires of the user, the organizer can be stored with the compartment flap in an opened position or in a closed position as shown in FIG. 1. At an end opposing the compartment flap, the compartment outer cover 35 is associated with a compartment bridge portion 31. As shown, the compartment bridge portion 31 also associates with the second bridge cover member 20.

Figure 6:
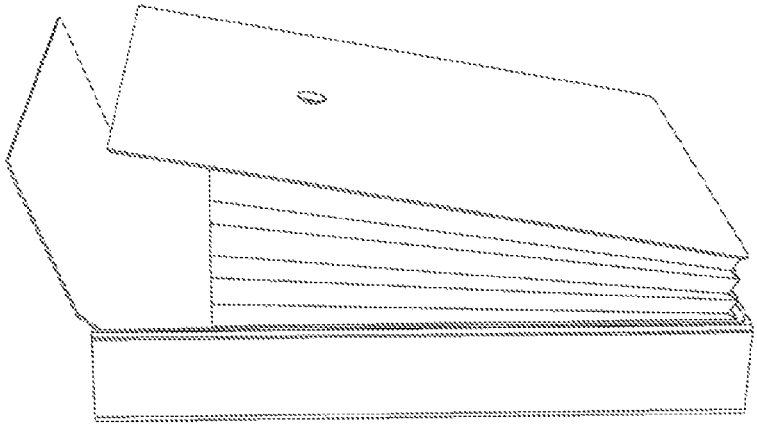
FIG. 6 shows a side perspective view of the embodiment shown in FIG. 5 with an expandable compartment in an opened position.
Figure 5:
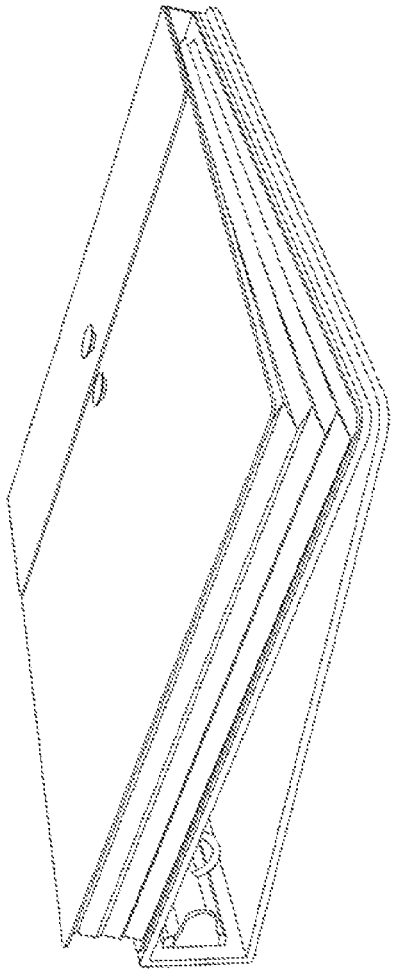
FIG. 5 shows a bottom perspective view of another embodiment of the invention.
Figure 8:
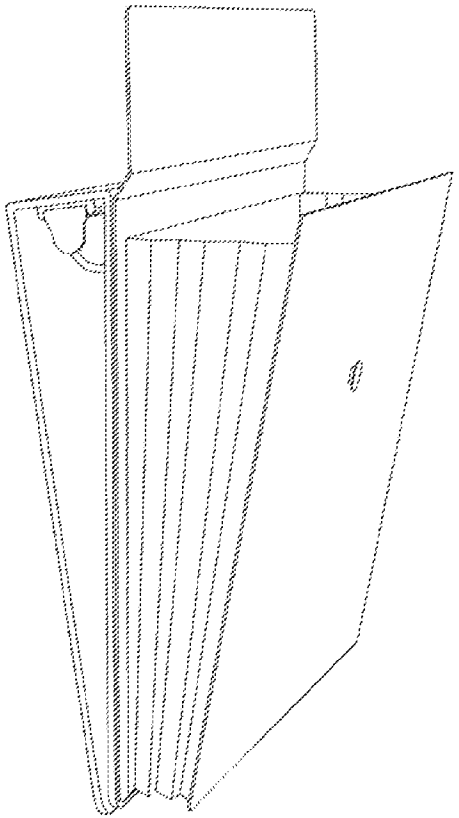
FIG. 8 shows a side perspective view of the embodiment shown in FIG. 7 with an expandable compartment in an opened position.
Figure 7:
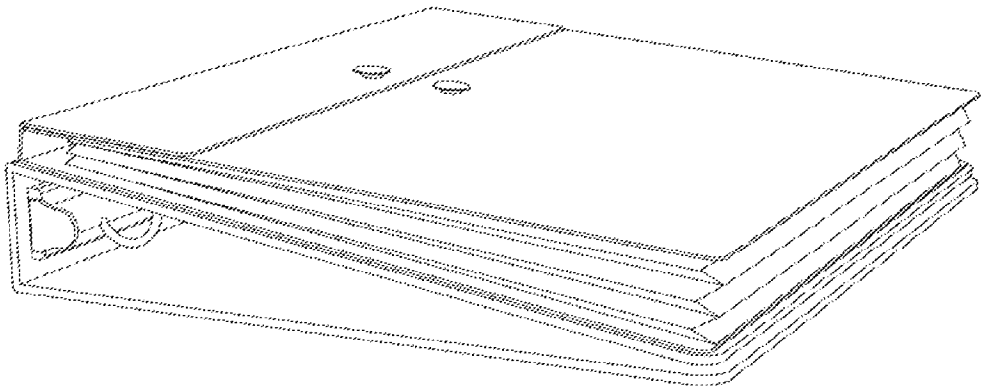
FIG. 7 shows a bottom perspective view of another embodiment of the invention.

FIGS. 5 & 6 show an alternative embodiment of an organizing binder. The arrangement shows an expandable compartment vertically aligned with respect to the ring binder. FIGS. 7 & 8 show an alternative embodiment with an expandable compartment aligned horizontally on the ring binder.

Figure 10:
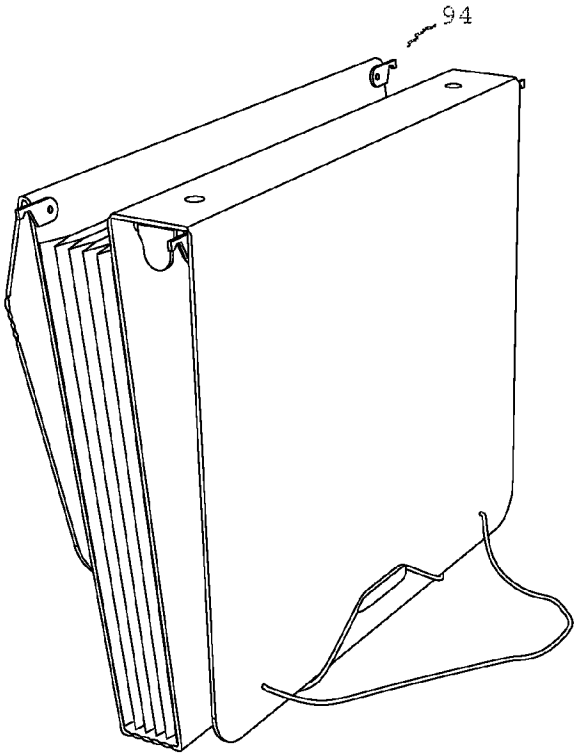
FIG. 10 shows a side perspective view of the embodiment shown in FIG. 9 with a compartment flap held in an opened position.
Figure 9:
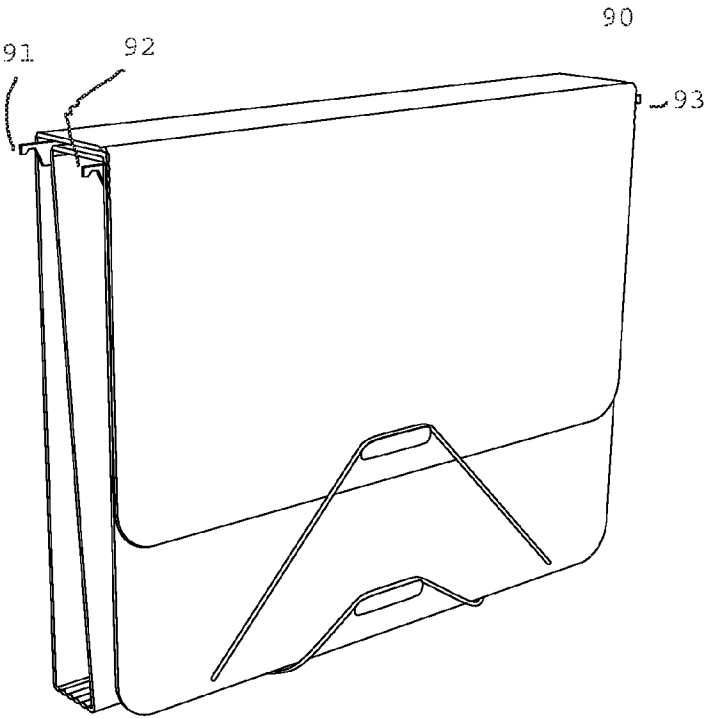
FIG. 9 shows a side perspective view of an embodiment that comprises hanging members.

FIG. 9 shows an embodiment 90 similar to that shown in FIG. 1, which includes hanging members 91, 92, and 93. FIG. 10 shows the embodiment of 90 with the compartment flap in an opened position. FIG. 10 also reveals hanging member 94. It is noted that the hanging members 91-94 are arranged and placed such that they can support the embodiment 90 whether the compartment flap is open or closed.

Figure 11:
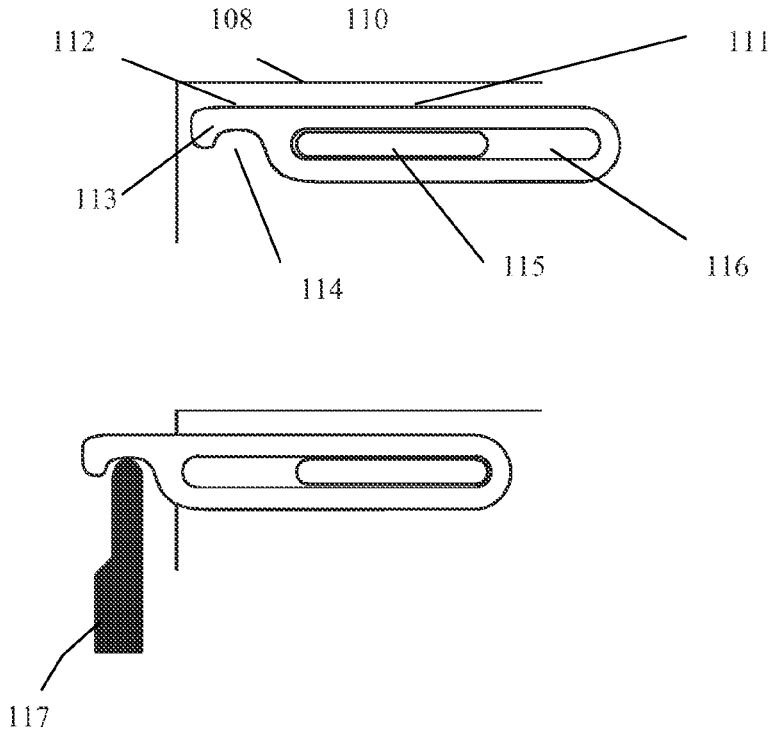
FIG. 11 shows a depiction of a hanging member embodiment.

FIG. 11 shows a hanging member embodiment 110 attached to a surface 108 of a binder. The hanging member 110 is shown in a retracted position (top) and an extended position (bottom). The hanging member 110 includes an elongated body portion 111 with a tab 113 disposed on a distal end 112 thereof. Defined on the distal end 112 is an indentation 114 to assist in retaining the binder. Defined within the elongated body portion 111 is a slot 115 that slides on a projection 116. The extended hanging member 110 rests on a rail 117 typically found in a hanging file cabinet.

Figure 12:
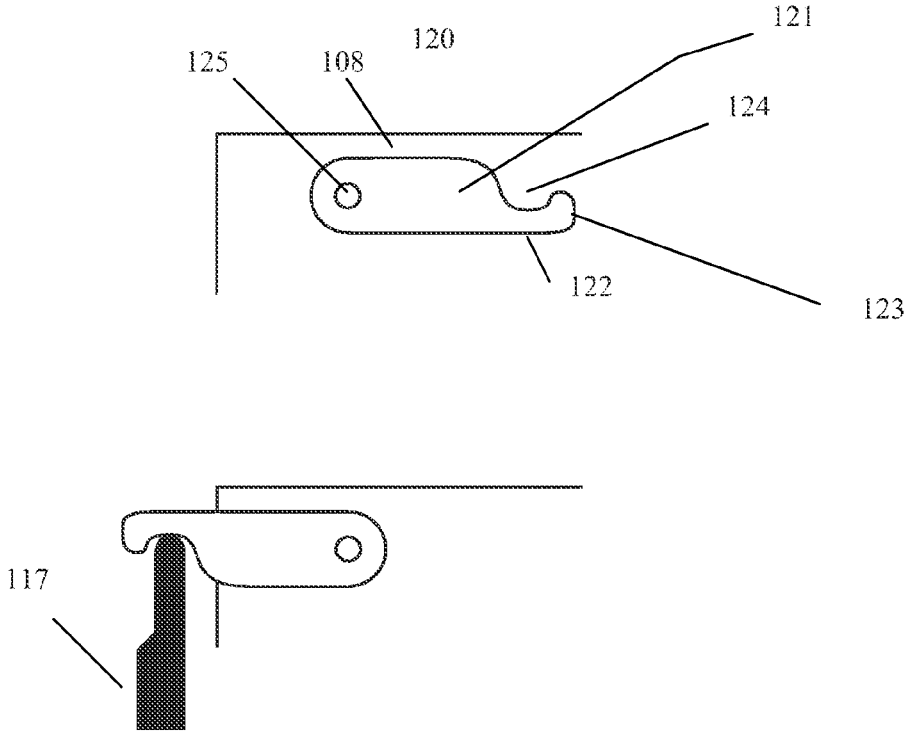
FIG. 12 shows a depiction of a hanging member embodiment.

FIG. 12 shows a hanging member embodiment 120 attached to a surface 108 of a binder. The hanging member 120 is shown in a retracted position (top) and an extended position (bottom). The hanging member 120 includes an elongated body portion 121 with a tab 123 disposed on a distal end 122 thereof. Defined on the distal end 122 is an indentation 124 to assist in retaining the binder. The hanging member 120 pivots around pin 125. The extended hanging member 120 rests on a rail 117 typically found in a hanging file cabinet.

Documents are typically stored on a shelf or in a hanging file folder cabinet. File folder cabinets typically include rails onto which hanging files can be hung. Embodiments of the present invention accommodate both a shelf or in a hanging file folder cabinet. In addition, if a device of the present invention is stored in a file folder cabinet, it can be stored fully closed or with the expandable compartment section open. To achieve this, the hangers are operably attached to a binder embodiment in a fashion that it enables the organizer to stored with the expandable compartment section in either an open position or in a closed position without interfering with the hanging function of the hanging members. The hanging members are configured such that they are secured in a lateral direction on rails of a file folder cabinet.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention. Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment. Furthermore, each individual component of any given assembly, one or more portions of an individual component of any given assembly, and various combinations of components from one or more embodiments may include one or more ornamental design features.

The invention claimed is:

1. An organizing binder comprising a first planar cover member and a second planar cover member, each said first and second planar cover member comprising an outer surface, an inner surface, a proximal edge, a distal edge, a first end edge and a second end edge;

a bridge member comprising a planar bridge body portion having a bridge inner surface, a bridge outer surface, a first bridge outer edge and a second bridge outer edge, wherein said first bridge outer edge associates with said first planar cover member proximal edge and said second bridge outer edge associates with said second planar member proximal edge;

a binding mechanism associated with said bridge inner surface, said first planar cover member inner surface or said second planar cover member inner surface, said binding mechanism comprising a plurality of binding members that move from a released state to binding state;

an expandable compartment associated with said second planar cover member outer surface, said expandable compartment comprising a first wall portion and a second wall portion spanning between a compartment outer cover and said second planar cover member outer surface, and defining an opening of the expandable compartment disposed between the bridge member and the compartment outer cover, wherein said first and second wall portions, or a combination thereof, comprise supernumerary material so as to allow expansion of said compartment outer cover away from said second planar cover member outer surface; and further comprising a compartment flap that moves from an open position, where material in said expandable compartment may be accessed, to a closed position, where material in said expandable compartment is inaccessible; wherein said compartment flap comprises a compartment flap first end that is associated with said compartment outer cover and a compartment flap second end that superimposes said bridge member outer surface, said first planar cover member outer surface, or said second planar cover member outer surface.

2. The binder of claim 1, wherein said first or second wall portions, or combination thereof comprise a series of folds.

3. The binder of claim 1, wherein said expandable compartment comprises two or more separate slits into which material may be separately stored.

4. The binder of claim 1, wherein said compartment flap second end is secured with a latching means.

5. The binder of claim 4, wherein said latching means is a hook and loop fabric adhered to said compartment flap second end.

6. The binder of claim 4, wherein said latching means is a catch member that holds a stretchable cord is secured at a location on said binder.

7. The binder of claim 4, wherein said latching mechanism is a snap, a button/slit configuration, a clip, a zipper, or a magnet.

8. The binder of claim 1, wherein binder further comprises a second bridge member spanning between an edge of said compartment outer cover and said bridge member outer surface, said second planar cover member outer surface, or said first planar cover member outer surface.

9. The binder of claim 8, further comprising a compartment flap that superimposes said second bridge member.

10. The binder of claim 1, wherein said binder further comprises two or more hanging members associated therewith, said two or more hanging members allowing said binder to be suspended on a support device.

11. The binder of claim 10, wherein said two or more hanging members move from a retracted position to an extended position.

12. The binder of claim 11, wherein said binder comprises a first set of two or more hanging members operably attached to said binder so as to extend in a first end direction and a second set of two or more hanging members operably attached to said binder so as to extend in a second end direction.

13. The binder of claim 12, wherein at least one hanging member of said first set and at least one hanging member of said second said is operably attached said first planar cover member, said second planar cover member or said compartment outer cover.

14. The binder of claim 12, wherein said first set of two or more hanging members comprises a first hanging member movably engaged to said first planar cover member and a second hanging member movably engaged to said second planar cover member.

15. The binder of claim 13, wherein when said two or more hanging members are unexposed in said retracted position, and exposed in said extended position.

16. An organizing binder comprising a first planar cover member and a second planar cover member, each said first and second planar cover member comprising an outer surface, an inner surface, a proximal edge, a distal edge, a first end edge and a second end edge;

a bridge member comprising a planar bridge body portion having a bridge inner surface, a bridge outer surface, a first bridge outer edge and a second bridge outer edge, wherein said first bridge outer edge associates with said first planar cover member proximal edge and said second bridge outer edge associates with said second planar member proximal edge;

a binding mechanism associated with said bridge inner surface, said first planar cover member inner surface or said second planar cover member inner surface, said binding mechanism comprising a plurality of binding members that move from a released state to binding state;

an expandable compartment associated with said second planar cover member outer surface, said expandable compartment comprising a first wall portion and a second wall portion spanning between a compartment outer cover and said second planar cover member outer surface, and defining an opening of the expandable compartment disposed between the bridge member and the compartment outer cover, wherein said first and second wall portions, or a combination thereof, comprise supernumerary material so as to allow expansion of said compartment outer cover away from said second planar cover member outer surface;

a first hanging member movably secured to said first planar cover member, said second planar cover member, or said compartment outer cover and a second hanging member, movably secured to said first planar cover member, said second planar cover member, or said compartment outer cover, wherein said first and second hanging members move from a retracted position to an extended position; and further comprising a compartment flap that moves from an open position, where material in said expandable compartment may be accessed, to a closed position, where material in said expandable compartment is inaccessible; wherein said compartment flap comprises a compartment flap first end that is associated with said compartment outer cover and a compartment flap second end that superimposes said bridge member outer surface, said first planar cover member outer surface, or said second planar cover member outer surface.

17. The binder of claim 16, wherein said first hanging member is operably attached to said first planar cover member, said second planar cover member or said compartment outer cover so as to extend in a first end direction and said second hanging member is operably attached to said first planar cover member, said second planar cover member or said compartment outer cover so as to extend in a second end direction.

18. The binder of claim 17, wherein when said first and second hanging members are unexposed in said retracted position, and exposed in said extended position.

* * * * *